US006361388B2

(12) United States Patent
Foreman

(10) Patent No.: US 6,361,388 B2
(45) Date of Patent: Mar. 26, 2002

(54) MARINE MOTOR DRIVE ASSEMBLY

(76) Inventor: Glenn D. Foreman, 9358 Springwood La., Sandy, UT (US) 84094

( * ) Notice: Subject to any disclaimer, the term of this patent is extended or adjusted under 35 U.S.C. 154(b) by 0 days.

(21) Appl. No.: 09/911,065

(22) Filed: Jul. 23, 2001

Related U.S. Application Data

(63) Continuation-in-part of application No. 09/599,904, filed on Jun. 23, 2000, now Pat. No. 6,302,750.
(60) Provisional application No. 60/161,513, filed on Oct. 12, 1999.

(51) Int. Cl.[7] ..... B63B 3/00
(52) U.S. Cl. ..... 440/83; 440/112; 277/336
(58) Field of Search ..... 440/82, 83, 112, 440/53; 277/336

(56) References Cited

U.S. PATENT DOCUMENTS

| | | | | |
|---|---|---|---|---|
| 2,096,223 | A | | 10/1937 | Chandler et al. |
| 3,752,111 | A | | 8/1973 | Meynier, Jr. |
| 3,841,257 | A | | 10/1974 | Strang |
| 3,896,757 | A | | 7/1975 | Kucher |
| 4,726,796 | A | | 2/1988 | Rivette, Jr. et al. ..... 440/55 |
| 4,936,593 | A | * | 6/1990 | Finney |
| 5,231,890 | A | | 8/1993 | Hayasaka |
| 5,310,372 | A | | 5/1994 | Tibbetts ..... 440/112 |
| 5,328,396 | A | | 7/1994 | Hayasaka ..... 440/86 |
| 5,349,818 | A | | 9/1994 | McFadyen et al. |
| 5,374,208 | A | | 12/1994 | von Bergen et al. ..... 440/80 |
| 5,403,218 | A | | 4/1995 | Onoue et al. |
| 5,522,703 | A | | 6/1996 | Okamoto |
| 5,683,278 | A | | 11/1997 | Pietsch et al. ..... 440/112 |
| RE36,342 | E | | 10/1999 | McFadyen et al. |
| 6,053,783 | A | | 4/2000 | Brunn ..... 440/78 |

* cited by examiner

*Primary Examiner*—Jesus D. Sotelo
(74) *Attorney, Agent, or Firm*—Thorpe North & Western, LLP

(57) ABSTRACT

A roller bearing drive assembly for a marine mud motor with an elongated drive tube containing a lubricant, the drive assembly configured for rotatably receiving a drive shaft including a propeller on the end. The drive assembly comprises a drive assembly housing containing an outer seal to restrict lubricant flow from the housing cavity, an inner seal to provide a lubricant chamber for pressurizing the lubricant, a bearing to rotatably connect the drive assembly housing to the drive shaft, and a seal cap to protect the outer seal from the elements.

20 Claims, 3 Drawing Sheets

MARINE MOTOR DRIVE ASSEMBLY

This application is a continuation-in-part of U.S. patent application Ser. No. 09/599,904, filed Jun. 23, 2000, now U.S. Pat No. 6,302,750, which claims priority to U.S. Provisional Application No. 60/161,513 filed Oct. 12, 1999.

TECHNICAL FIELD

The present invention relates generally to a marine mud motor drive assembly, particularly useful as part of the drive shaft mechanism in a marsh motor on a shallow water boat.

BACKGROUND

A marine mud motor is a specialized marine motor used to propel a boat in shallow water applications. These motors are useful in marshes or other shallow water areas where the propeller frequently comes in contact with rocks, mud, logs, and weeds, etc., at the bottom of the body of water. Because these motors operate in shallow water, near the bottom of the body of water, the water they operate in often contains a great deal of dirt, sand or other particulate matter. This water that contains suspended matter creates an environment that is more erosive to moving motor parts than a clean water environment. The motor and drive shaft are designed to propel boats in extreme conditions by allowing the propeller to ride gently over these obstacles with minimal damage to the drive.

A marine mud motor, illustrated in FIG. 1, includes a frame 8 that supports an engine 14. The frame is mounted on a boat 10 by an engine mount 30. A long drive tube 16 is coupled to the frame by supports 28 and the drive tube contains a drive shaft 26. A propeller 22 is connected to the drive shaft and moves the boat forward. This design has been used for more than 30 years and is in use throughout the U.S. and Asia today to propel boats through adverse shallow water conditions.

The conventional design described above has a long drive tube 16 that encases a drive shaft 26 which is three to seven feet in length. This design includes a drive shaft, which is supported during rotation by bronze or composite bushings pressed into the drive tube, one on the bottom end and one on the top end of the drive tube. The bushings are contained in the drive tube assembly 16, which is generally filled with lubrication or grease. Marine mud motors using bronze or composite bushings pressed into the drive tube have been in production around the world for over 30 years.

As with any device operated under water, moisture is a serious problem. Seals are used to keep water out and lubricants inside the drive. Because bronze and composite bushings do not corrode easily, they have conventionally been used as a wear surface in the drive. Roller bearings used in the environment have repeatedly failed due to corrosion and alignment difficulties associated with this conventional design. In addition to the problems caused by corrosion due to moisture, the environment in which marine mud motors operate increases the wear on moving parts due the high level of dirt or silt suspended in the water. The wear caused by dirt, sand or other particulate contained in the muddy water compounds the corrosion problems caused by moisture. The use of roller bearings has failed due to the extreme conditions in which the motors are used, and the eventual intrusion of water, dirt, sand or other particulate, which quickly rusts and seizes the bearing, leading to extremely early failure.

To avoid this early drive shaft failure, multiple seals conventionally are used and the drive tube is filled completely with grease. Even with multiple seals and filling the tube with grease, water, dirt, and particles enter the drive and cause early bearing failure. This early bearing failure usually takes less than two years, even with constant attention and lubrication. For example, users must frequently fill the drive tube with grease, which tends to leak out.

Another significant problem is due to the drives' inherent design. The rotating shaft causes a Venturi effect which draws water up inside the drive tube past the multiple seals. Because the drive is in frequent contact with the bottom of the body of water, silt and sand accompany the water, which is pulled into the drive tube. Of course, the silt, particles and sand significantly accelerate bushing and drive tube wear and induce early failure.

Even more water and silt is pulled into the drive tube when the drive is at rest in the water. This is caused by cooling parts that create a vacuum, which draws water inside the drive. This additional water, silt and sand further contribute to the problem caused by the Venturi effect.

Because of these problems, bronze bushings, composites and even ceramics have been used as a wear surface for the rotating drive shaft. Other bearings have been tried, but the sand, dirt and water wear them out in a very short time. Accordingly, the use of bronze or composite bushings in the drive tube has been the industry standard.

Conventional drive tubes are completely, or nearly completely, filled with grease which lubricates both the top and bottom drive bushings. This lubrication helps combat any moisture that enters the system and helps to hydraulically balance the long drive shaft, which tends to vibrate during operation due to its length. Seals mounted on each end of the drive tube retain the grease inside the tube and prevent contaminants from entering the drive tube. The lower end of the drive tube supports the propeller and commonly features multiple seals, usually three. The seals are positioned in the conventional direction, that is with the lip of the seal toward the medium to be contained. One of the seals is positioned with the lip toward the grease inside the drive tube, to retain the grease inside the drive tube. One or two of the three seals are positioned with the lips toward the water, in an effort to prevent water from entering the drive tube. Multiple seals are used because the long drive tube causes a Venturi effect, which attempts to draw water inside the drive tube. The outer two seals slow this "pumping" process down. Regardless, the Venturi effect is strong and eventually small amounts of water with silt enter the system and cause accelerated wear and contamination of the lubricant. For this reason, bearings have not been used successfully because the moisture and dirt causes early bearing failure. Thus, only bushings have been used for the past 30-plus years.

Traditional bushings of almost any thickness can be used, however bushings with a thickness of approximately ⅛ of an inch are usually selected. By selecting bushings that are relatively thin, the size of the drive tube can be minimized. Conventional drive tubes have an inside diameter only slightly larger than the outside diameter of the drive shaft. This is desirable for a number of reasons. For instance, the gap between the tube and the shaft is completely, or nearly completely, filled with grease. Increasing the gap may necessitate an increase in the amount of grease used, which may also increase the costs of maintaining the drive assembly.

In addition to concerns described above, the components of mud motors are designed to be as light as possible in order to minimize fuel consumption and loss of power. By maintaining a relatively small diameter tube and drive shaft, the weight of the drive assembly can be minimized. Increasing the diameter of the drive tube also increases the surface area of the tube in contact with the water. Because the end of the drive tube near the propeller is submerged in water, the water exerts an upward force on the drive tube as the boat travels through the water. This upward force can be considerable, and if the drive has sufficient surface area, it may force the drive tube out of the water. This can cause the drive tube to hydroplane, or "fly" out of the water. By maintaining a relatively small drive tube, with a correspondingly small surface area, the lift is reduced as the boat travels through the water.

SUMMARY OF THE INVENTION

It has been recognized that it would be advantageous to develop a system which would allow bearings to be used in a marine motor drive shaft. In addition, it would be valuable to have a device which can overcome the Venturi effect and stop the flow of water, silt and sand into a drive shaft.

The present invention provides a drive assembly for a marine mud motor with an elongated drive tube containing a lubricant. The drive tube rotatably receives a drive shaft including a propeller on the drive shaft end. The drive assembly comprises an expanded drive assembly housing having an upper end, lower end, and housing cavity. The inside diameter of the expanded drive assembly housing is larger than the inside diameter of the drive tube, allowing for selection of bearings and/or seals of a larger diameter than the drive tube, so that a conventional drive tube can be used with larger sized bearings. An outer seal is mounted in the lower end of the drive assembly housing and structured to stop lubricant flow from the housing cavity. An inner seal is provided, between the outer seal and the upper end of the drive assembly housing, and spaced apart from the outer seal to provide an area for pressurized lubricant.

In accordance with one aspect of the present invention, the system includes a drive assembly containing a roller bearing and a structured seal arrangement, enclosed in an expanded assembly housing. The roller bearing drive assembly provides a drive rotation pressure which overcomes the system's inherent Venturi effect by first reversing the Venturi effect, and then creating a pressurized lubricant chamber. The drive assembly contains a bearing set and two or more seals. Two seals can develop the desired results, although more than one bearing or two seals may be used. Hydraulic pressure is generated on the lower end of the bearing due to its accelerated rotation and slope. This pressure is used to force lubrication or grease past the lip of the innermost seal, which is installed in a reverse direction. The grease then flows under pressure into a chamber between the inner and outer seals. The pressurized lubricant in the lubricant chamber cannot escape because the two seals are installed in opposite directions, allowing pressurized lubricant to enter from the bearing side but not escape the area between the two seals. The developed pressure reverses the normal tendency of the drive to create a Venturi effect that attempts to draw water inside the drive tube past seals into the drive tube which leads to increased wear, corrosion, and early failure. Alone, this pressure helps keep water out of the system, but when captured in a seal assembly, a secondary barrier is provided that maximizes its sealing capability, thus extending the life of the drive.

This configuration allows the use of roller bearings in mud motors that could not use roller bearings as a wear surface due to water contamination. The use of an integral assembly having a removable housing, containing at least one bearing, at least one seal, and seal cap benefits this application. By utilizing an expanded housing, the present invention can be used with smaller drive tubes and drive shafts, regardless of the outside diameter of the bearings and seals selected. The present invention can also be advantageously used on the upper end of a mud motor drive tube, where the tube and drive shaft are attached to the motor of the boat.

Additional features and advantages of the invention will be set forth in the detailed description which follows, taken in conjunction with the accompanying drawings, which together illustrate by way of example, the features of the invention.

DETAILED DESCRIPTION

Figure 1:
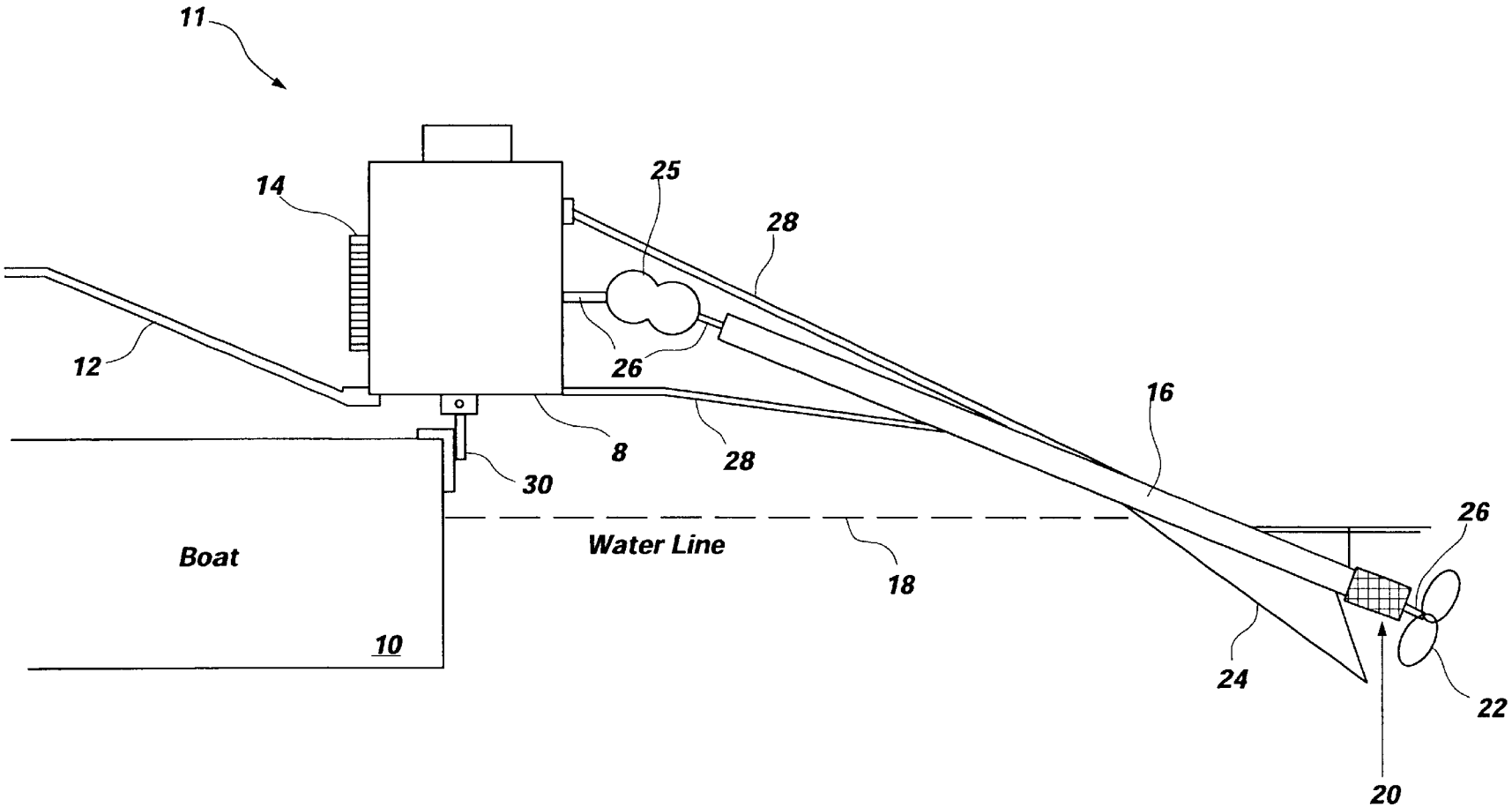
FIG. 1 is a side view of a marine mud motor mounted on a boat.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

As illustrated in FIG. 1, a marine mud motor system 11 is shown for propelling a boat 10 through shallow water 18. These types of motors are used in marshes and swampy areas. In accordance with one aspect of the present device, the marine mud motor system includes a frame 8 that supports an engine 14. The frame is mounted on the boat by an engine mount 30. The marine mud motor system includes a roller bearing drive assembly 20 with an elongated drive tube 16 containing a lubricant. In addition, the drive tube rotatably receives a drive shaft 26 through the drive tube. The motor drives the drive shaft via a universal joint 25. The long drive tube is coupled to the frame by supports 28, and includes a rudder fin 24 that is directionally controlled by the operator handle 12. A propeller 22 is coupled onto the end of the drive shaft to move the boat forward. The roller bearing drive assembly 20 can also be used on the upper end 29 of the drive tube 16, where the drive shaft 26 enters the drive tube 16 (this use not shown).

Figure 2:
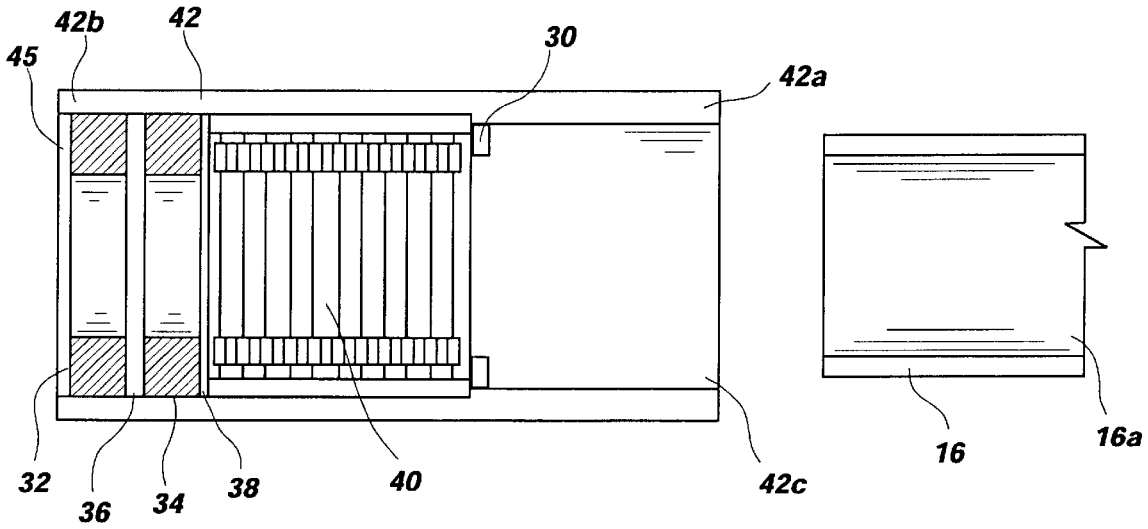
FIG. 2 is a lengthwise cross-sectional side view of the roller bearing drive assembly housing without the drive shaft.

The roller bearing drive assembly, as depicted in FIG. 2, comprises a drive assembly housing 42 having an upper end 42*a*, lower end 42*b*, and a housing cavity 42*c*. The roller bearing drive assembly housing operates below the water line. A roller bearing 40 can be mounted inside the drive assembly. An outer seal 32 is mounted into the lower end of the drive assembly housing. The outer seal is oriented to restrict lubricant flow from the housing cavity. An inner seal 34 is located between the outer seal and the roller bearing drive assembly housing, and is spaced apart from the outer seal to provide an area for pressurized lubricant 36. A seal cap 45 is mounted on the lower end of the roller bearing drive assembly to retain the seals inside the housing and to protect the seals from outside elements. The seal cap 45 can alternately be configured to contain the seals 32 and 34 within the seal cap itself, thereby minimizing the necessary number of components.

More specifically, the space between the outer seal 32 and inner seal 34 forms a lubricant chamber 36 between the inner seal and outer seal. The lubricant chamber is generally pressurized by lubricant flowing past the inner seal. A one-way seal is used for the inner seal because it only allows some lubricant to flow past it in one direction. Bearing rotation causes the lubricant to press past the innermost seal in the lubricant chamber. After the lubricant has passed the inner seal, it is generally trapped between the outer seal and inner seal, creating pressure which builds up during operation. The pressurized lubricant chamber provides a significant improvement over conventional designs in that it acts as a barrier to keep water and particles out of the drive assembly housing.

Conventionally, a single seal is placed in the drive shaft to prevent grease from leaking outside of the enclosed system. Sometimes multiple seals, oriented away from the grease, are also used to keep water from passing by the seal into the drive tube. Regardless, the Venturi effect is strong and eventually small amounts of water containing silt enter the system and cause accelerated wear and contamination of the lubricant. The contamination also breaks down the seals and allows lubricant to escape from the drive tube.

One embodiment of the present invention utilizes shaft seals to prevent water from entering the drive assembly housing. Conventional shaft seals include a seal lip designed to prevent fluid flow in one direction by forming a dynamic seal over the shaft. These types of seals are generally used to retain fluid, such as grease or oil, inside a cavity. The lip generally faces toward the fluid that is to be retained and can include a metallic spring to assist the lip in forming a seal over the shaft. Conventional shaft seals are designed to not only retain fluid inside a cavity, but to prevent outside contaminants from entering the cavity. However, when the outside contaminants are at a higher pressure than the fluid inside the cavity, the seals cannot effectively resist contaminant flow into the cavity. This is the problem that has heretofore prevented the use of bearings in drive tube assemblies of mud motors. The Venturi effect inside the drive tube assembly creates a lower pressure inside the housing than that of the water outside the seal. The negative pressure allows water and contaminates to eventually flow past the seal and quickly erode and corrode the bearings.

The preferred configuration of the present device places two shaft seals back-to-back, facing in opposite directions, with the inner seal being reversed from conventional usage. Consistent with conventional usage, the outer seal is positioned to restrict fluid, in this case lubricant or grease, from flowing out of the drive assembly housing. However, contrary to conventional usage, the inner seal is positioned to restrict fluid from flowing up the drive tube, toward the upper end of the drive tube. The seals are separated by a small gap, which, in conjunction with the current configuration of the seals, creates a lubricant chamber between the seals.

The present device advantageously utilizes the fact that shaft seals allow small amounts of fluid to flow past the seals when operated between pressure differentials. As the drive shaft is operated, the grease inside the drive tube becomes pressurized. As a result, the inner seal, which is positioned to restrict fluid flow toward the upper end of the drive tube, eventually allows a small amount of grease to flow from the drive tube into the small gap between the seals, which serves as a pressurization chamber. The grease in the pressurization chamber then pressurizes the chamber, eventually reaching equilibrium with the pressure inside the drive tube. The pressure inside the pressurization chamber is greater than that of the water outside the chamber. As a result, the Venturi effect conventionally encountered with using bearings and seals inside a mud motor drive assembly is resisted, and the outer seal is much more effective at preventing water from entering the drive tube. Thus, the orientation and arrangement of the seals, which creates a pressurized lubricant chamber between two seals, allows for the use of roller bearings in an environment in which they could heretofore not be effectively used.

The pressurization chamber remains pressurized when the drive is rotating or at rest. This pressurized chamber provides a superior barrier that prevents water from entering the drive tube when running. When the system is not operating and is at rest, it cools but remains pressurized and keeps water and silt from being drawn past the seal configuration and into the drive due to the vacuum caused by the cooling and shrinking of parts and lubrication within the drive tube. In the prior art, water has a tendency to be drawn into the drive assembly housing 42 when the drive is operated or when it cools. This leads to accelerated deterioration and early failure of the seals and drive parts.

Figure 5:
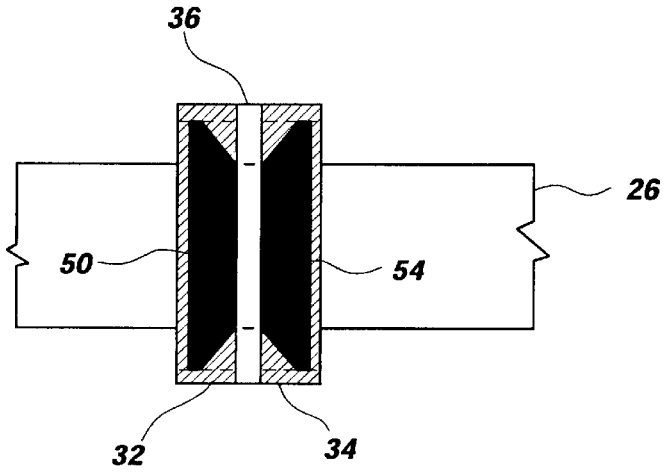
FIG. 5 is a side view of an inner and outer seal showing the lips on the seals in accordance with the present invention.

Referring now to FIG. 5, a side view of the seals is shown. In the preferred embodiment, the outer seal 32 is positioned in the conventional direction, with the lip facing toward the upper end of the drive tube, oriented to contain the grease inside the pressurization chamber. The inner seal 34 is positioned with the lip facing toward the lower end of the drive tube, oriented to restrict fluid from flowing up the drive tube, toward the upper end of the drive tube. The lips of both seals can be initially held tight against the drive shaft 27 with springs (not shown) embedded in the lips of the seals. The pressure from the springs is greatly increased by the pressure inside the pressurization chamber, allowing for a very effective seal on the drive shaft. Other configurations which perform the same functionality can also be used, such as the use of double lip seals (not shown) having an outer wiper lip designed to prevent large contaminants from contacting the primary inner seal.

Figure 4:
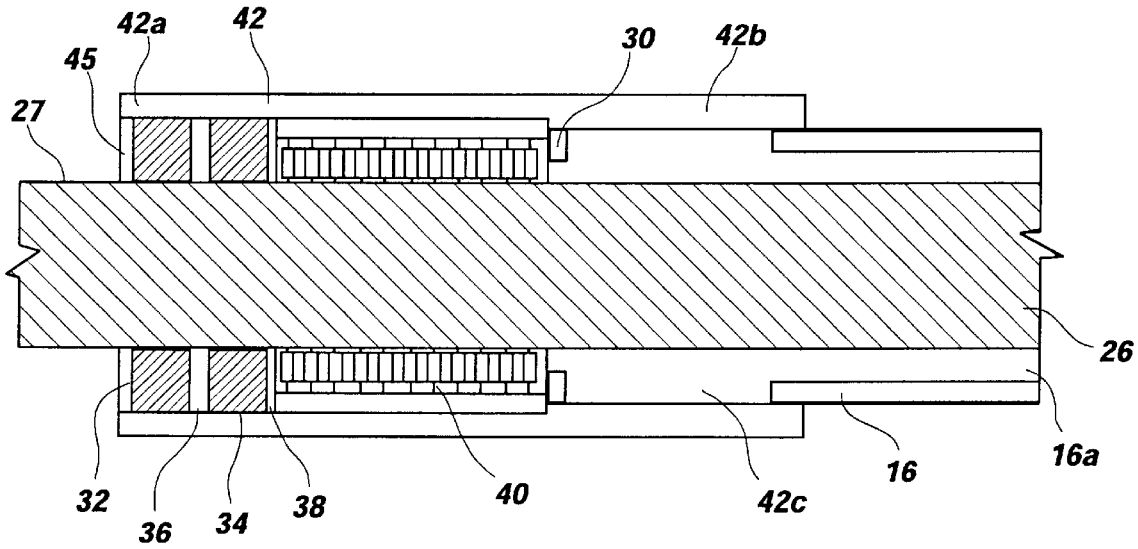
FIG. 4 is a lengthwise cross-sectional side view of the drive assembly housing, containing a roller bearing, seals, seal cap and a drive shaft.

As illustrated in FIGS. 2 and 4, a bearing 40 is located in the drive assembly housing 42. This bearing is located forward of the outer seal 32 and inner seal 34. The drive assembly housing 16A and roller assembly housing 42C are filled with a lubricant and form a type of lubricant reservoir. This lubricant may be a grease, thick oil or other lubricant well know to those in the art for drive shaft lubrication. Preferably, the grease used is a marine grade grease which is filled to a level above the roller bearing to create head pressure that allows the spinning roller bearing in the drive assembly to build pressure on the lower end of the roller bearing. Hydraulic pressure is generated on the lower end of the bearing due to its accelerated rotation, relatively larger size, and slope. This pressure is used to force lubrication or grease past the lip of the innermost seal, which is installed in a reverse direction as compared to the prior art. The bearing pressure also circulates the lubrication through the drive shaft which significantly reduces the frequency of maintenance required by a user.

The bearing 40 can be a roller bearing, a ball bearing or an equivalent bearing or bearings used by those skilled in the art. The preferred bearing is a needle or roller bearing or one or more ball bearings. Previously a bearing has not been used because it would wear out too quickly as a result of water, dirt, sand, silt and other particles entering the drive shaft. Also, because a bearing requires near perfect alignment to operate, the prior art did not use roller bearings incorporating machined parts that are assembled in one unit to provide use of the roller bearing while protecting its life through the use of a seal mechanism that maintains a pressure chamber to protect the bearings from water, silt and other contaminants. Another major advantage of the use of a bearing is that its wear surface out-lasts and out-performs bushings and composites when used in a non-contaminated environment.

The configuration of a roller bearing and structured seals reverses the Venturi problem in the drive shaft which has not been solved for decades. Water is no longer drawn through the drive assembly housing into the drive tube because of the pressure provided by the roller bearing. To provide added benefit, this pressure buildup is used in conjunction with a seal assembly design to build a pressurized chamber, which provides additional protection for the bearing by preventing water from entering the system during operation. The seal set is pressurized within the first 5 to 10 minutes of operation and maintains a set pressure for the life of the seals. Every time the system is run it continues to re-pressurize the area between the two seals protecting the bearing from moisture. This protective arrangement increases the ease of maintenance for the marine mud motor.

An additional advantage is provided because the pressurized lubricant chamber maintains its pressure when the engine is not running and prevents water from being drawn into the drive tube caused by retraction of cooling parts.

The lubricant chamber can also be pressurized using some other pressurization member for pressurizing the area between the outer and inner seals with lubricant. For example, a direct conduit can be directed into the pressurization chamber which would allow pressurized grease to be pumped or fed via a spring loaded assembly into the lubricant chamber between the two seals. Alternatively, an impeller in the drive tube can produce pressure within the lubricant, forcing grease past inner seal 34 into the area between inner seal 34 and outer seal 32.

When using a roller bearing to pressurize the lubricant chamber 36, it is advantageous to have an area 38 for the roller bearing to build lubricant pressure so the lubricant is forced past the inner seal. Accordingly, a pressurization gap can be used between the inner seal and the roller bearing to pressurize lubricant from the roller bearing which passes by the inner seal. For example, a gap greater than 1/16 of an inch may be used to allow lubricant pressure to build up from the bearing. Referring to FIG. 4, the drive assembly housing 42 is attached to the drive tube 16 on the outside or inside of the drive tube. Outside attachment is preferable to increase circulation of the lubricant within the drive tube, extending maintenance intervals. The drive assembly housing can also be attached inside the drive tube or formed as an expanded, integral part of the drive tube. The roller bearing drive assembly housing includes a seal cap 45 which protects the outer seal 32 from debris and wear. The cap can be pressed into the unit, screwed, glued or welded onto the lower end of the unit. The seals 32 and 34 can also be contained within seal cap 45, thus forming a seal cap with integrated seals which can be used to minimize the number of necessary components while achieving the same advantageous results.

Figure 3:
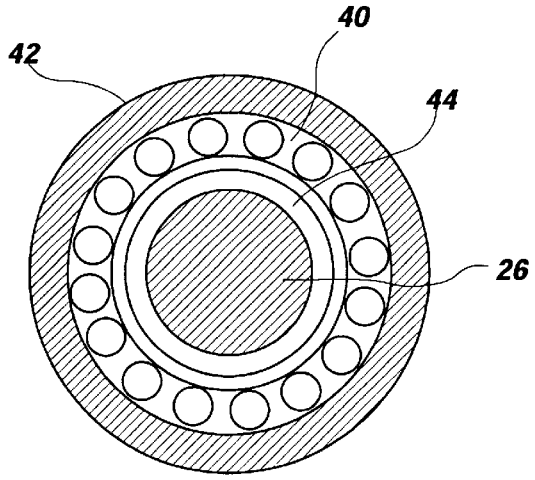
FIG. 3 is a cross-sectional end view of the drive assembly housing.

Referring now to FIG. 3, a cross sectional view of the roller bearing and drive assembly housing are shown. A drive shaft 26 is coupled to the roller bearing sleeve 44 and the roller bearing 40 allows the drive shaft to spin within the drive assembly housing 42 and drive the propeller. The drive assembly housing is made from machined stainless steel or other non-corrosive material to reduce corrosion. The machined inner bore of the housing is designed to contain the pressed-in bearing assembly and two seals. More seals can be used if desired. The opposite end of the inner bore of the housing is designed to be pressed onto or into the drive tube. A strong connection may be made by positioning the housing over the drive tube, which provides the additional benefit of allowing a continuous path for the flow of lubricant from the inside of the drive tube to the inside of the housing. The drive assembly housing can also be screwed, glued, or welded into or over the drive tube. The assembly housing can also be manufactured as an integral part of the drive tube, either formed as or machined from the same piece of material.

FIG. 4 depicts the drive shaft 26 running through the drive assembly housing 42 and drive tube 16. The drive assembly housing is larger in diameter than conventional drive tube housings. The drive assembly housing can be adapted for use with bearings and seals of any diameter, regardless of the size of the drive shaft or tube used. By utilizing a drive assembly housing 42 that is expanded relative to the inside diameter of the drive tube 26, the present invention can advantageously be used in applications where it is desirable to minimize the size of the drive tube and shaft, yet allow the use of larger bearings and seals to maximize the frictional protection provided by the bearings. The cavity formed between the drive assembly housing and drive tube contains a lubricant such as grease. The drive shaft passes through the roller bearing 40, the inner seal 34, and the outer seal 32 to form a pressurized lubricant chamber 35 which is located between the seals and surrounds the drive shaft. A propeller can be connected at a lower end 27 of the drive shaft.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A drive assembly for a marine mud motor, comprising:

a) an elongate drive tube, configured for rotatably receiving a drive shaft therethrough, wherein a lower end of the drive tube includes;

b) a drive assembly housing, having a lower end;

c) a bearing, in rotational communication between the drive assembly housing and the drive shaft; and d) a seal, contained within the drive assembly housing, configured to restrict contaminants from entering the drive assembly housing.

2. A drive assembly as in claim 1, further comprising a seal cap, coupled to the lower end of the drive assembly housing, configured for retaining the seal within the drive assembly housing.

3. A drive assembly as in claim 2, wherein:

a) the lower end of the drive assembly housing has screw threads; and b) wherein the seal cap has screw threads, to allow the seal cap to be threadably connected to the lower end of the drive assembly housing.

4. A drive assembly as in claim 2, wherein the seal cap includes at least one seal contained within the seal cap.

5. A drive assembly as in claim 1, wherein the drive assembly housing further comprises an inside and the elongate drive tube has an outside, and wherein the inside of the drive assembly housing is coupled to the outside of the elongate drive tube.

6. A drive assembly as in claim 1, wherein the drive assembly housing and the drive tube are an integral unit.

7. A drive assembly for a marine mud motor, comprising:

a) an elongate drive tube having an inside, an outside and a lower end, configured for rotatably receiving a drive shaft therethrough, wherein the lower end of the drive tube includes;

b) an enlarged drive assembly housing having an inside, an outside, an upper end and a lower end, wherein the inside diameter of the enlarged assembly housing is larger than the inside diameter of the elongate drive tube;

c) a bearing, in rotational communication between the enlarged drive assembly housing and the drive shaft; and d) a seal, contained within the enlarged drive assembly housing, configured to restrict contaminants from entering the enlarged drive assembly housing.

8. A drive assembly as in claim 7, wherein the bearing includes an outside diameter larger than the inside diameter of the drive tube.

9. A drive assembly as in claim 7, further comprising a seal cap, coupled to the lower end of the enlarged drive assembly housing, configured for retaining the seal within the enlarged drive assembly housing.

10. A drive assembly as in claim 7, wherein:

a) the lower end of the enlarged drive assembly housing has screw threads; and b) wherein the seal cap has screw threads, to allow the seal cap to be threadably coupled to the lower end of the enlarged drive assembly housing.

11. A drive assembly as in claim 9, wherein the seal cap includes at least one seal contained within the seal cap.

12. A drive assembly as in claim 7, wherein the inside of the enlarged drive assembly housing is coupled to the outside of the elongate drive tube.

13. A drive assembly as in claim 7, wherein the enlarged drive assembly housing and the drive tube are an integral unit.

14. A drive assembly for a marine mud motor, comprising:

a) an elongate drive tube having an inside diameter, an outside diameter and a bottom end, configured for rotatably receiving a drive shaft therethrough;

b) the bottom end of the elongate drive tube includes an enlarged drive assembly housing having an inside, an outside, an upper end and a lower end, wherein the inside diameter of the enlarged drive assembly housing is larger than the inside diameter of the elongate drive tube;

c) an outer seal, contained within the enlarged drive assembly housing, oriented to restrict fluid from flowing in a direction from the upper end of the enlarged drive assembly housing to the lower end of the enlarged drive assembly housing;

d) an inner seal, contained within the enlarged drive assembly housing, oriented to restrict fluid from flowing in a direction from the lower end of the enlarged drive assembly housing to the upper end of the enlarged drive assembly housing, wherein the inner seal is positioned nearer to the upper end of the enlarged drive assembly housing than the outer seal;

e) a pressurization area, formed between the inner and outer seals; and f) at least one bearing, in rotational communication with the drive assembly housing and the drive shaft, positioned between the inner seal and the upper end of the enlarged drive assembly housing.

15. A drive assembly as in claim 14, wherein the at least one bearing includes an outside diameter larger than the inside diameter of the drive tube.

16. A drive assembly as in claim 14, further comprising a seal cap, coupled to the lower end of the enlarged drive assembly housing, configured to retain the seals within the enlarged drive assembly housing.

17. A drive assembly as in claim 16, wherein:

a) the lower end of the enlarged drive assembly housing has screw threads; and b) wherein the seal cap has screw threads, and wherein the seal cap is threadably coupled to the lower end of the enlarged drive assembly housing.

18. A drive assembly as in claim 16, wherein the seal cap includes at least one seal contained within the seal cap.

19. A drive assembly as in claim 14, wherein the inside of the enlarged drive assembly housing is coupled to the outside of the drive tube.

20. A drive assembly as in claim 14, wherein the enlarged drive assembly housing and the drive tube are an integral unit.

* * * * *